United States Patent [19]

Brun

[11] Patent Number: 4,530,858

[45] Date of Patent: Jul. 23, 1985

[54] PROCESS AND INSTALLATION FOR CONTINUOUS MANUFACTURING OF AN OLD (OVER-AGED) STEEL BAND HAVING A COATING OF ZN, AL OR ZN-AL ALLOY

[75] Inventor: Charles Brun, Montataire, France

[73] Assignee: Union Siderurgique du Nord et de L'est de la France (Usinor), Puteaux, France

[21] Appl. No.: 612,958

[22] Filed: May 23, 1984

[30] Foreign Application Priority Data

May 24, 1983 [FR] France ..... 8308508

[51] Int. Cl.[3] ..... B05D 3/00

[52] U.S. Cl. ..... 427/320; 427/321; 427/433; 427/398.1; 148/12 D; 148/12.3

[58] Field of Search ..... 427/320, 321, 433, 398.1; 148/12.3, 12 D

[56] References Cited

U.S. PATENT DOCUMENTS

| | | | |
|---|---|---|---|
| 3,971,862 | 7/1976 | Fukuoka | 427/433 |
| 4,287,008 | 9/1981 | Torok | 148/12 D |
| 4,287,009 | 9/1981 | Allegra | 427/433 |
| 4,294,632 | 10/1981 | Kubota | 148/12.3 |

FOREIGN PATENT DOCUMENTS

| | | | |
|---|---|---|---|
| 0046139 | 4/1979 | Japan | 148/12 D |
| 0122820 | 9/1980 | Japan | 148/12 D |
| 0122821 | 9/1980 | Japan | 148/12 D |
| 0079161 | 5/1982 | Japan | 427/433 |

OTHER PUBLICATIONS

EP-0026757, 4/1981.

*Primary Examiner*—Sam Silverberg

*Attorney, Agent, or Firm*—Cushman, Darby & Cushman

[57] ABSTRACT

The present invention relates to a continuous coating process by a layer of Zn, Al or of a Zn-Al alloy for a cold laminated steel band comprising a heating thermic cycle, followed by a rapid cooling, a tempered coating in the metal bath of coating in fusion, at a temperature from 460° to 500° C., and a subsequent cooling, characterized in that after the tempered coating, the coated steel band is subjected to an over-aging treatment by maintaining the band at a temperature comprised between 430° and 270° C. during at least two minutes.

This process is carried out in an installation comprising an over-aging chamber.

5 Claims, 2 Drawing Figures

PROCESS AND INSTALLATION FOR CONTINUOUS MANUFACTURING OF AN OLD (OVER-AGED) STEEL BAND HAVING A COATING OF ZN, AL OR ZN-AL ALLOY

The present invention relates to a process and a plant for continuous coating with zinc, aluminum or with a zinc-aluminum alloy on a steel band obtained by cold lamination.

The purpose of the invention is especially, but not exclusively, to accomplish a process of galvanization of a cold laminated steel band.

In the conventional galvanization processes presently in use, the hardened metal by cold laminating having the form of a band is first of all subjected to a continuous annealing treatment. This treatment comprises a heating thermic cycle and maintaining that temperature, followed by a more or less rapid cooling stopped at fusion temperature of the zinc bath. After the heating treatment, followed by the more or less rapid cooling, the steel band is galvanized tempered in a zinc bath at a temperature between about 460° and 500° C., then the band is continuously extracted from the zinc bath and cooled before being stocked in bobbins.

Various operations are carried out on the zinc coating proceeding from the liquid bath in order to give it the desired properties.

Coming out from the zinc bath, the metal is completely recrystallized but the carbon in solution in the course of the heating period and maintenance of the heat treatment remains in the state of oversaturated solution in the ferrite. If at this stage, cooling of the coated steel band is continued until a temperature lower than 270° C., at a speed higher than 5° C. per second, part of the carbon remains in solution. The oversaturated carbon in solution in the ferrite renders the metal sensitive to ageing by precipitation of the carbon in oversaturation on the dislocations caused by the cold deformation that the sheet metal will be subsequently subjected to.

Ageing which takes place during the two months following deformation does not permit to carry out the surface cold-hammering on the galvanization line, because the mechanical characteristics of steel treated in those conditions would be unstable in time. In fact, hardening caused by ageing is accompanied by a reappearance of the elastic level outflow suppressed by the surface cold-hammering and, consequently, in the course of the subsequent operation, the metal will show structural defects (facets) or hollow surface (vermicular, worn-shaped, sinuous) defects caused by nonuniform and random plastic deformation.

According to the technique actually actually in operation, in order to avoid this type of defects caused by ageing, carbon is precipitated in oversaturation by a prolonged reheating in bobbins. In order to avoid transforming the present zinc coating on the fragile iron-zinc alloy steel band, reheating must be effected at a temperature lower than 300° C. and must be long, in order to obtain at the same time sufficient uniformity of temperature and a complete precipitation of the carbon. Experience shows that this result is reached after maintaining temperature higher than 250° C. for 6 hours.

The cold-hammering surface operation which eliminates the elastic level and imparts a regulated roughness to the sheet metal surface can be then carried on on the metal having been subjected to such over-ageing, without risk of subsequent ageing. However, such a cycle of over-ageing, which cannot be carried on continuously, is costly and lengthens the production cycle.

The purpose of the present invention is to obviate this disadvantage in order to supply a coated sheet metal which can be treated continuously and possesses the required technical qualities.

Thus the object of the invention is a continuous process of coating with a layer of Zn, Al or with a Zn-Al alloy, a cold laminated steel band, comprising a heating thermic cycle, followed by a rapid cooling, a coating tempered in the metal bath of coating in fusion, at a temperature from 460° to 500° C., and a subsequent cooling, characterized in that the tempered cooling, the coated steel band is subjected to an over-ageing treatment by maintaining the band at a temperature between 430° and 270° C. for at least 2 minutes.

According to a characteristic of this process, rapid cooling following the heating thermic cycle must be carried on at a speed of 5° to 50° C./s., preferably from 10° to 50° C./s, and even better from 10° to 25° C./s.

According to another characteristic of the present invention, the over-ageing treatment is carried out between 430° and 330° C. by presenting the same surface to the band in contact with the guiding rolls according to a helix path.

The steel band subjected to the over-ageing treatment is coated on one of its two faces with a layer of zinc, aluminum or of their alloys. In the case where the band comprises a conventional coating on only one of its faces, the guiding rolls are arranged in such a way that they are in contact with the face free of the coating layer.

Another object of the present invention is an installation for continuous coating with a layer of Zn, Al or a Zn-Al alloy, of a cold laminated steel band comprising band feeding means, a thermic treatment chamber comprising heating means followed by cooling means, a crucible for maintaining in fusion the coating metal in which are arranged return means for the band and extraction and guiding means of the band towards a stocking post after cooling, characterized in that the installation comprises following the coating bath, after extraction means, an overageing chamber maintaining the coated band at a temperature comprised between 430° and 270° C. during at least two mn., this chamber comprising an assembly of guiding rolls arranged in such a way that, during a first passage of the band, only one face of the latter is in contact with the guiding rools.

According to another characteristic, the guiding rolls determine in the first path a helix winding, then subsequently a second accordion path until exit from the chamber.

The invention is described in more detail below with the help of the attached drawings, which represent only one form of embodiment.

The invention will be described below with reference to a continuous galvanization process, but this technique can also be applied to aluminizing or to coating with a zinc-aluminum alloy.

Figure 1:
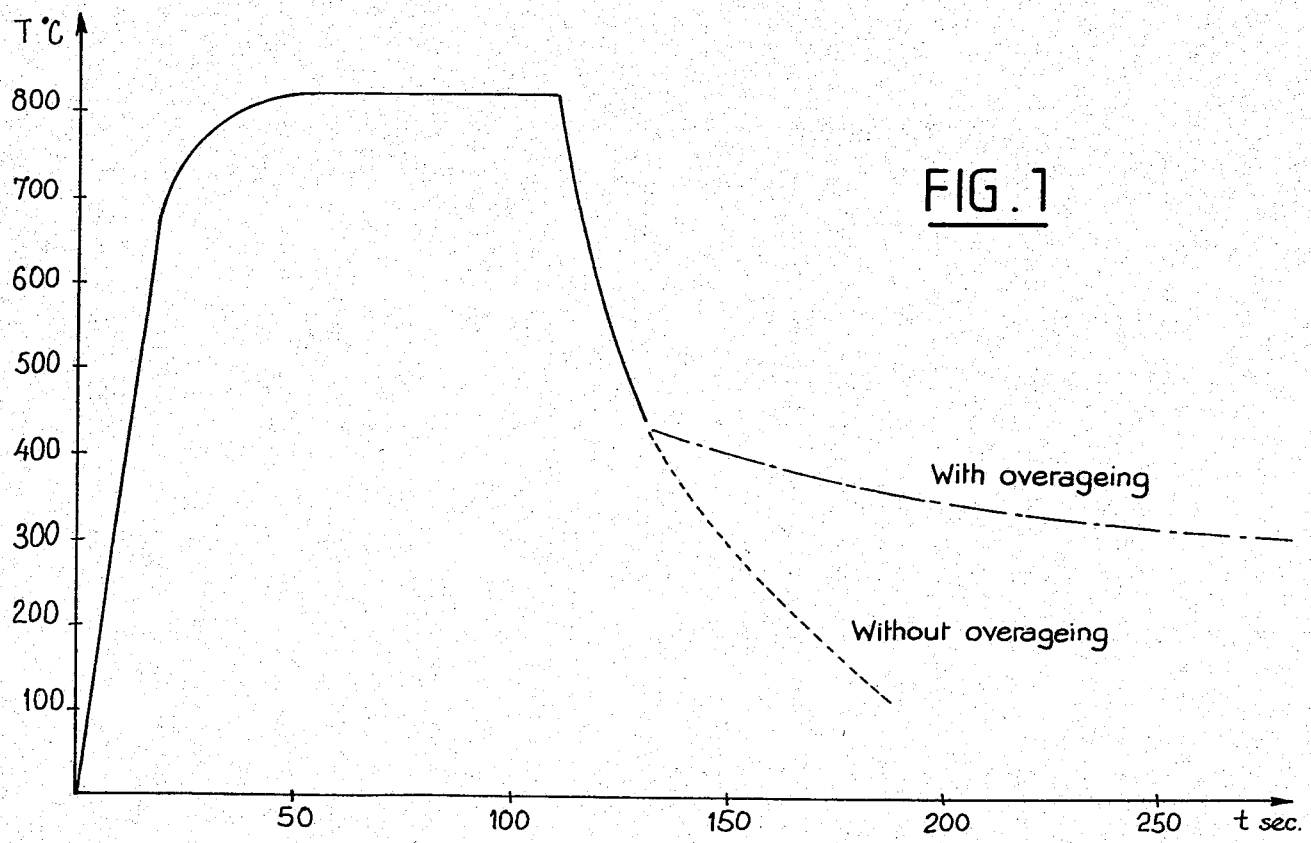
FIG. 1 is a schematic view illustrating the thermic cycle followed by the band in the course of continuous galvanization.
Figure 2:
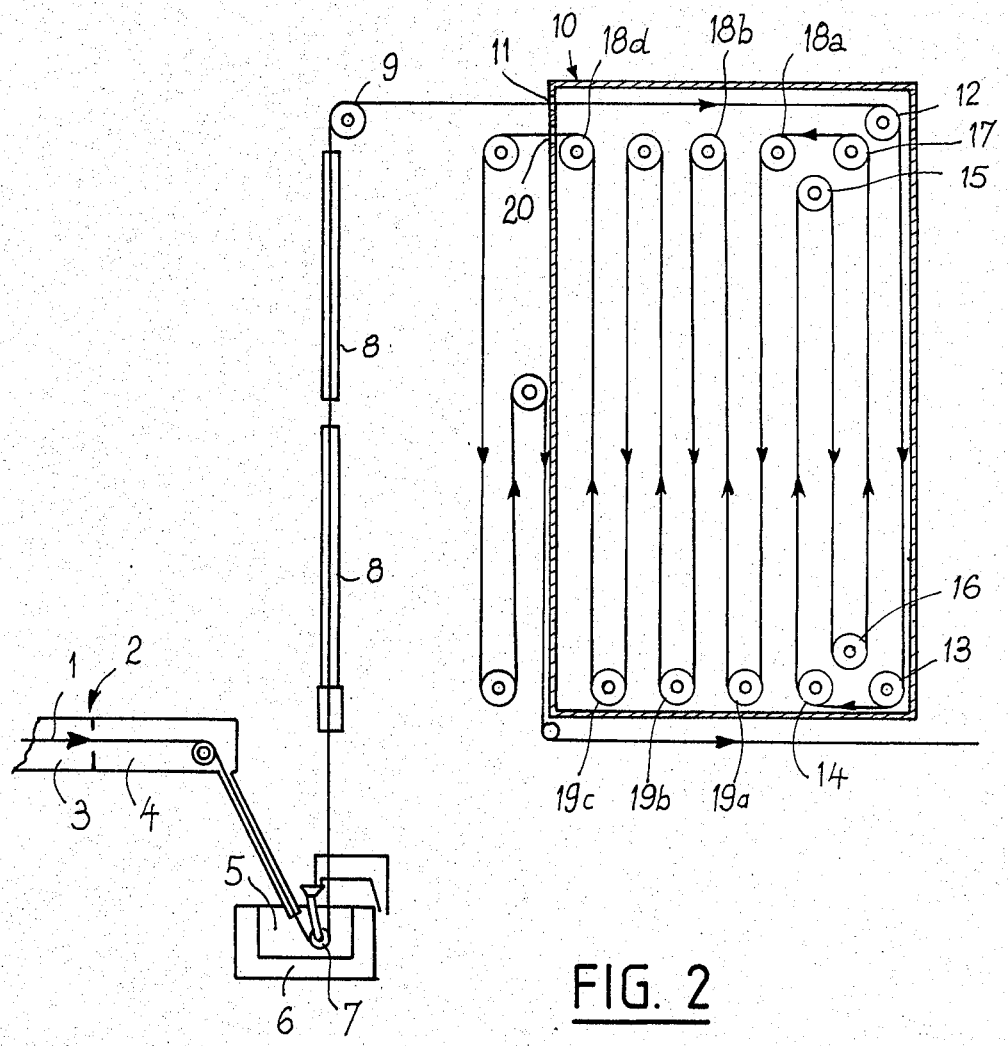
FIG. 2 is a partial schematic view of a continuous coating installation according to the present invention in the part comprising the over-ageing chamber.

A steel band hardened by cold laminating is first of all subjected to a continuous reheating treatment in the line of galvanization according to a thermic cycle which is illustrated at FIG. 1.

This thermic cycle comprises:

a very rapid heating phase up to a temperature comprised between 550° and 750° C. about, the heating speed being comprised between 20° and 200° C./s. about;

a slower heating phase until a maintenance temperature comprised between 650° and 850° C. about, the heating speed being comprised between 5° and 50° C./s.;

a maintenance phase at a temperature comprised between 650° and 850° C. for a duration from 20 seconds to about 3 minutes;

a rapid cooling of the maintenance temperature of entry into the zinc bath in fusion which is at a temperature comprised between 460° and 500° C., cooling speed being from 5° to 50° C./s and, preferably, higher than 10° C./s;

tempered galvanization towards 450° C. in a zinc bath for a time comprised between 1 and about 10 seconds;

continuing cooling of the zinc coated band comprising a continuous over-ageing treatment on the galvanization line which will be described later.

The over-ageing treatment can be considerably shortened if it is effected after rapid cooling of the metal before entry into the zinc bath. A complete overageing can be obtained by maintaining during at least 2 minutes between 430° and about 270° C., providing that the rapid cooling speed of about 800° C. to about 470° C. be preferably higher than 10° C./s.

Carrying out such a cycle for a galvanized product, however, has the disadvantage of having to maintain the zinc at a temperature higher than 330° C. for a prolonged period of time, which increases the risk of sticking and of friction of the zinc coating in contact with the guiding rools of the line.

One of the original characteristics of the process of the present invention consists in minimizing this risk by an arrangement of the guiding rolls in relation to the band, in such a manner that only one face of the band, in the portion where the band is at a temperature higher than 330° C. is in contact with the guiding rolls. Thus the risk of scratches for the face not in contact with the guiding rolls in the part where the band is at a temperature higher than 330° C. is completely avoided.

The face thus saved from contact with the guiding rolls will be reserved as visible face, for example in building sheet metal that must present a perfect surface.

On the schematic view of FIG. 1, the thermic cycle undergone by the steel band representing, on the one part, the over-ageing according to the present invention and, on the other part, normal cooling of the band without over-ageing, has been represented.

The process of the present invention is realized in an installation partially accomplished at FIG. 1.

On this FIG. 1, the cold laminated steel band 1 is supplied from feeding means not shown in a furnace 2, where it is subjected to a reheating treatment with a heating phase in the zone 3 and cooling in the zone 4. The band 1 is then continuous tempered galvanized in a zinc bath in fusion 5 contained in a crucible 6. This crucible is provided with return means of the band under the form of a roll 7 immersed in the zinc bath. The band 1 is then vertically extracted from the zinc bath 5 and subjected to conventional treatment operations of the zinc layer deposited in zones 8 and is guided by a roll 9 in the direction of the over-ageing chamber 10. The steel band bearing its zinc coating is introduced into the over-ageing chamber 10 by an aperture 11 at a temperature in this location in the neighborhood of 370° C. The over-ageing chamber 10 comprises an assembly of guiding rolls disposed horizontally and parallel to each other. The band 1 travels in this enclosure over a first path since its entry 11 passing on guiding rolls 12, 13, 14, 15 and 16 following an helix winding, so that the same face of this band since its exit from the zinc bath is (will be) in contact with the guiding rolls. When it reaches the level of guiding roll 16, the temperature of the band is about 330° C., so that it is then possible to place the face not having been subjected to any contact with the guiding rools, in contact with the latter. From roll 16, the band travels an accordion path on rollers 17 and 18*a* to 18*d*, as well as 19*a* to 19*c*, the rollers 18*a* to 18*d* being disposed respectively at the upper part of the enclosure, while rollers 19*a* to 19*c* are arranged at the lower part of the latter. The band is extracted from the chamber 10 by an aperture 20 at a temperature of 270° C. and sent with the help of appropriate rollers towards a hardening station not shown, after cooling until a temperature is at 50° C.

Temperature of the enclosure is regulated in a manner as to assure a band temperature of 370° C. at least at the entrance of the enclosure and of at least 270° C. at the exit of the chamber.

The length of the over-ageing zone is provided in such a way that the effective time between exit from the zinc bath and exit from the over-ageing zone at a temperature higher than or equal to 270° C. is at least 2 minutes and, preferably, comprised between about 2 and 5 minutes for galvanization of the steel intended to be covered with metal.

The galvanized steel band reaches at the end of the line a hardening rolling mill not shown, in a manner as to eliminate the elastic level outflow and to impart a regulated roughness to the sheet metal, then the band is wound up and stocked.

An important characteristic of the guiding rolls of the overageing chamber is that they must have a diameter such that the diameter ratio on thickness of the band is more than 800, so as to avoid hardening the metal by cold-hammering.

The guiding rolls are, for example, hollow steel rolls with a rectified surface, having a fine corrugations (0.5 μm), browned by oxidation between 300° and 500° C.

An oxidation treatment carried out on the guiding rolls of the over-ageing zone and self-maintained by atmospheric oxidation, creates a layer resisting sticking or friction of the band providing the roughness of the rolls is lower than 0.5 μm.

In the case where the galvanized steel band presents on one of its faces a zinc coating of conventional thickness and on its other face a thin iron-zinc alloy coating obtained by elimination of the zinc coating previously deposited, the face comprising the thin iron-zinc alloy coating in contact with the guiding rolls 9 and 12 to 15 of the over-ageing treatment zone, is presented. This permits maintenance of the conventional zinc coating out of contact with the guiding rolls during the first helix wound travel path. The face comprising the thin ironzinc coating not being subjected to deterioration in contact with the guiding rolls, no deterioration of its qualities is being observed.

In order to show the obviousness of the advantageous characteristics obtained by the process of the present invention, three cycles of galvanization are carried out as defined below.

Cycle 1 corresponds to the prior technique without over-ageing treatment with a continuous cold-hammering in the line of 1%.

Cycle 2 corresponds to galvanization according to the prior technique with a bobbin over-ageing not allowing for continuous treatment.

Cycle 3 corresponds to the process of the present invention.

CYCLE 1

Continuous galvanization at 820° C.
Cooling from 820° to 470° C./s. from 430° to 270° C. at 5° C./s.
Cold-hammering 1% in line.

CYCLE 2

Continuous galvanization at 820° C.
Cooling from 820° to 470° C. at 10° C./s. from 430° to 270° C. at 5° C./s.
Over-ageing 6 hours at 280° C.
Cold-hammering 1%.

CYCLE 3

Continuous galvanization at 820° C.
Cooling from 820° to 470° C. at 10° C. from 430° to 270° C. at 0.8° C./s.
Cold-hammering 1% in line.

The mechanical characteristics of the product obtained after cold-hammering in the various cycles are given in the following table, first of all in the delivery state at the exit from the lines and, then, after two months of stocking at 30° C.

It can be verified after reading this table that in cycle 3 according to the present invention, the increase of the elastic limit is small after two months of keeping in stock and completely comparable to that obtained for cycle 2 not allowing for total continuous galvanization on all the line.

Reappearance of the elastic level is, moreover, relatively weak in relation to cycle 1 not comprising any over-ageing stage.

I claim:

1. Continuous process for coating a cold laminated steel band with a layer of Zn, Al or with a Zn-Al alloy, comprising a heating thermic cycle which comprises a very rapid rise in temperature until a temperature comprised between 550° and 750° C. at a speed of 20° to 200° C./s., slower continued rise in temperature until a maintenance temperature comprised between 650° and 850° C. at a speed of 5° to 50° C./s. and maintaining this temperature for about 3 minutes, followed by rapid cooling at a speed of 5° to 50° C./s of from the maintenance temperature to the coating bath temperature, a tempered coating in the metal bath of coating in fusion at a temperature of 460° to 500° C., and a subsequent cooling, characterized in that after the tempered coating, the coated steel band is subjected to an over-ageing treatment by maintaining the band at a temperature between 430° and 270° C. for at least two minutes.

2. Process according to claim 1, characterized in that the coated band being subjected to the over-ageing treatment comprises in this over-ageing zone a face coated with a conventional zinc coating and a face coated with a thin iron-zinc alloy layer which is put in contact with the guiding rolls.

3. Process according to claim 1, characterized in that the rapid cooling at the end of the heating thermic cycle, from the maintenance temperature to the coating bath temperature, is accomplished at a speed from 10° to 50° C./s.

4. Process according to claim 3, characterized in that the cooling speed is from 10° to 25° C.

5. Process according to claim 1, characterized in that the over-ageing treatment is accomplished between 430° and 330° C. by presenting the same face of the band in contact with the guiding rolls according to a helix travel path.

* * * * *